United States Patent [19]

Seegmiller

[11] Patent Number: 4,699,547

[45] Date of Patent: Oct. 13, 1987

[54] MINE TRUSS STRUCTURES AND METHOD

[76] Inventor: Ben L. Seegmiller, 3500 E. Loren Von Dr., Salt Lake City, Utah 84124

[21] Appl. No.: 809,140

[22] Filed: Dec. 16, 1985

Related U.S. Application Data

[63] Continuation-in-part of Ser. No. 712,158, Mar. 15, 1985, abandoned.

[51] Int. Cl.[4] ..... E21D 21/00

[52] U.S. Cl. ..... 405/288; 405/259; 411/538

[58] Field of Search ..... 405/288, 259, 260, 262; 52/657; 411/537, 538, 531, 536, 539

[56] References Cited

U.S. PATENT DOCUMENTS

| | | | |
|---|---|---|---|
| 1,036,439 | 8/1912 | Brown | 52/657 |
| 1,471,159 | 10/1923 | Howie et al. | 52/657 |
| 3,139,730 | 7/1964 | Williams et al. | 405/259 |
| 3,427,811 | 2/1969 | White | 405/259 |
| 4,349,300 | 9/1982 | Kelly | 405/288 |
| 4,395,161 | 7/1983 | Wilson et al. | 405/288 X |
| 4,456,405 | 6/1984 | Galis | 405/259 X |
| 4,498,816 | 2/1985 | Korpela et al. | 405/259 |
| 4,596,496 | 6/1986 | Tyrell et al. | 405/259 X |

FOREIGN PATENT DOCUMENTS

| | | | |
|---|---|---|---|
| 813393 | 9/1951 | Fed. Rep. of Germany | 405/288 |
| 0899119 | 6/1962 | United Kingdom | 405/288 |
| 554412 | 4/1977 | U.S.S.R. | 405/259 |

OTHER PUBLICATIONS

Evaluation of Roof Trusses, Phase 1 Dept. of Civil Engineering, Univ. of Pittsburgh, Feb. 28, 1979, prepared for United States Dept. of the Interior–Bureau of Mines.

*Primary Examiner*—Dennis L. Taylor
*Attorney, Agent, or Firm*—M. Ralph Shaffer

[57] ABSTRACT

A method of essentially maintaining the integrity of mine floors and precluding floor heave, this without the necessity of incorporating timber cribs, jacks and so forth, as utilized in the prior art. Floor integrity is maintained with a minimum of obstruction of the mine opening. Truss structures herein are designed to deter floor heave and, optionally, also may be adjusted in certain instances for employment as roof trusses even though stress patterns of the strata will differ. Truss-bracket, channel, and allied constructions are incorporated and are of advantageous design as hereinafter pointed out. Of special import is the bracket, of nominal triangular cross-section which facilitate through-placement of tie rods and anchor bolts in tension and in a manner deterring the generation of force couples. The truss structures will be installed between mine pillars, broadly defined as any side structure, rock or otherwise, spanned by a mine- or tunnel-roof.

10 Claims, 15 Drawing Figures

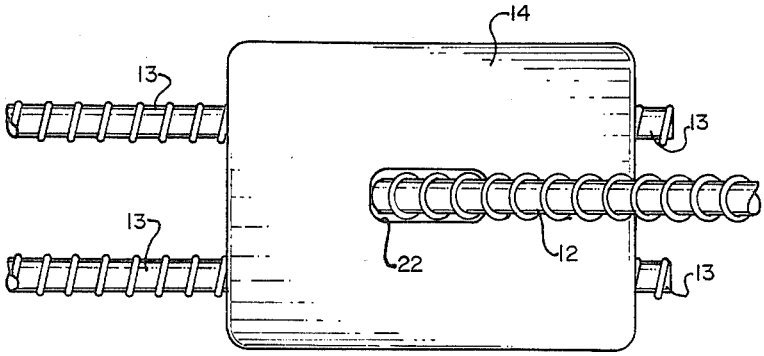
FIG. 4
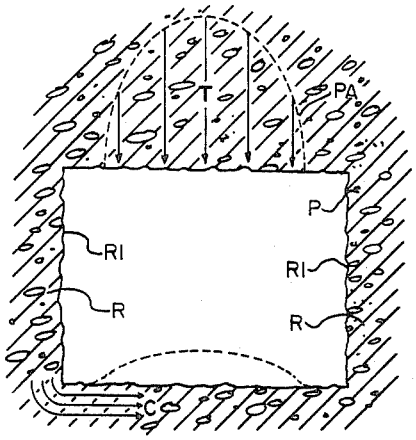
FIG. 5A
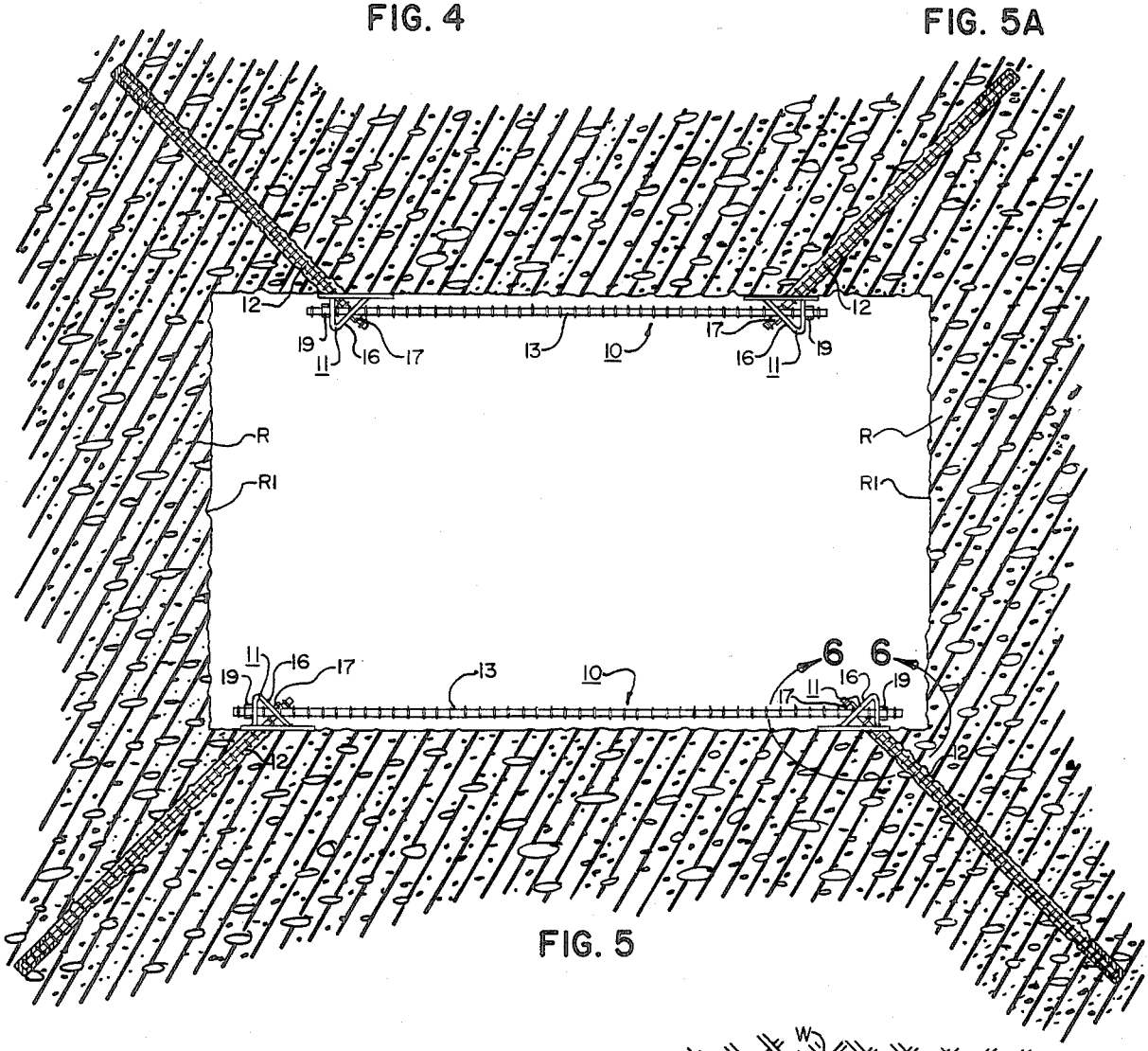
FIG. 5
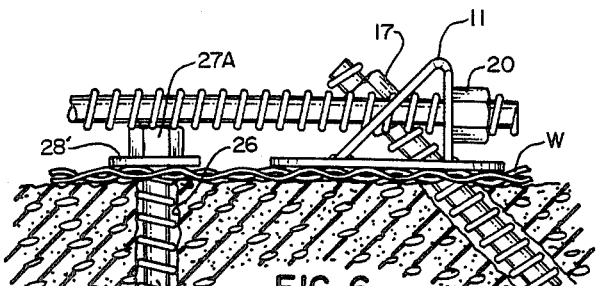
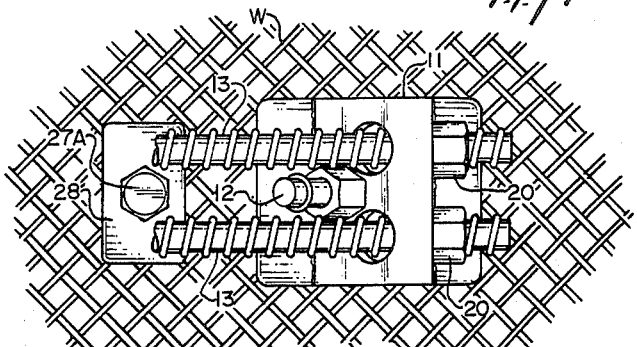

MINE TRUSS STRUCTURES AND METHOD

CROSS-REFERENCES TO RELATED APPLICATIONS

This is a continuation in-part of U.S. patent application Ser. No. 06/712,158, entitled MINE TRUSS STRUCTURES AND METHOD, filed Mar. 15, 1985, now abandoned without prejudice.

FIELD OF INVENTION

This invention pertains to mines, tunnels, and the like, more particularly, relates to (1) the general concept and method of trussing mine floors and (2) the advantageous utilitarian design of truss structures that are useful both in floor and ceiling truss systems.

DESCRIPTION OF PRIOR ART

No prior art is currently known which addresses the problem of eliminating, by use of an active tensile system, tendencies of floor heave in mines, tunnels, and allied constructions; however, there do exist prior art passive support structures that drastically reduce the opening size of the tunnel or mine portion involved. These latter structures take the form of timber cribs, jacks, and so forth.

As to structures to facilitate maintenance of mine floor integrity, the present invention provides uniquely designed brackets, channels, and composite structures for maintaining the same. As to both channels and brackets utilized in connection with anchoring bolts, each will include an angulated bearing surface employed as a reaction surface for the nuts threaded onto anchoring bolts such as roof bolts. Accommodating apertures are provided for appropriate passage of roof- or anchor-bolts and tie rods where utilized. Certain of the structures used for compression stressing floors can also be employed in connection with mine roofs, as between adjacent pillars, for example.

There has been prior art addressed as to mine roofs. Essentially different problems are encountered as to the roofs relative to the floors as is hereinafter pointed out. In any event, the prior art as to the truss structures for roofs include the so-called Birmingham truss as is illustrated in an initial patent to White, U.S. Pat. No. 3,505,824, which was a continuation of U.S. Pat. No. 3,427,811. Another popular design for ceiling truss structures only is manufactured by the Jennmar Corporation known as the "Bethlehem" design for trusses, U.S. Pat. No. 4,395,161.

A further discussion and evaluation of various types of roof trusses is found in a document entitled "The Evaluation of Roof Trusses—Phase I" prepared for the U.S. Dept. of the Interior, Bureau of Mines, by the Dept. of Civil Engineering, University of Pittsburgh, Summary Report dated Feb. 28, 1979. The above patents and article are fully incorporated therein by way of reference.

In connection with the structures shown in U.S. Pat. No. 4,395,161, there is a basic problem of critical spacing of the primary devices and that the structures will not accommodate situations where the roof bolts may be closely spaced or disposed rather far apart. In the applicant's invention, in contrast, the use of the threaded tie rods and the access areas of the brackets permit an indefinite extension of the tie rods, depending upon their length, through the brackets where the brackets are rather closely spaced together. Also, there is no interference as between the tie rods and the roof bolts or other structure in the applicant's invention, as contrasted with U.S. Pat. No. 4,395,161.

As to the Birmingham truss structure, the rods utilized have to be bent during the process of installation, that is, going from the angulated position of the roof anchor hole to the horizontal position intended for the truss. Furthermore, turnbuckles, and complicated block arrangements are needed to complete the installation in U.S. Pat. No. 3,505,824. The structure has proven quite time-consuming for mine installations; likewise, frequently there is complaint by mine personnel as to the requirement of in situ bending during the installation process. Similar objections can be raised in connection with other types of trusses as currently known.

BRIEF DESCRIPTION OF INVENTION

It is imperative to note that the present invention deals with an active system for, e.g., pre-stressing the mine floor to prevent floor heave. This is to be contrasted with passive systems where the cribs or other supports are installed, where the earth is not pre-stressed thereby, but rather that should a cave-in or a heave commence, the cribbing system, for example, will tend to prevent this. The present invention in contrast is not passive but active, imposing the state of pre-stressing at the outset. This likewise applies to roof truss installations.

While the present invention may not in all context totally eliminate all cribbing in all mines, yet crib structures can be reduced to a bare minimum and thus will maintain the integrity of the cross-sectional open area of the mine and its components for desired usage.

According to the present invention, the concept of trussing a mine floor is considered unique; in one form of the invention horizontal tie rods or equivalent and/or advantageous brackets for the purpose of trussing is central and is believed unknown in the prior art. Accordingly, multi-timber cribs, jacks, and so forth, can be substantially eliminated, thus reducing frictional forces as to air passage and also utilizing a maximum opening for the use of personnel, expulsion of ore, and so forth.

A particularly useful object in practice of the invention, and which can be used for floor and roof truss structures, is a unique bracket that simply requires threaded nuts used for the tensioning of bolts and tie rods utilized. Accommodation apertures are provided in the bearing plate structure of each truss bracket. Appropriate reaction surfaces are provided for the nuts required and utilized to tension the tie rods and also the anchor bolts. A preferred type of truss bracket is designed to substantially reduce, if not eliminate, force couples and also, by the design thereof, to insure maximum stability and integrity through anticipated loadings of the truss bracket by tension-type tie rods to be connected thereto.

In other preferred forms of the invention, relative to the mine floor, there are provided composite rod and wire mesh structures that complement the truss structures to give further strength in maintaining floor integrity, preserving mine opening, and precluding tendencies of floor heave.

OBJECTS

Accordingly, a principal object of the present invention is to provide a method and also an active system or apparatus for trussing mine floors to preserve floor integrity and deter floor heave.

A further object is to provide suitable structure integral with and also operationally associated with trusses suitable for trussing mine and tunnel floors.

A further object is to provide a new and improved bracket and channel structures for use in trusses for both floors and roofs of mines, tunnels, and the like.

An additional object is to provide structure that can be easily and quickly handled, in a most convenient manner, to erect active system trusses in mines, tunnels, and the like.

An additional object is to provide a new and improved truss bracket capable of withstanding substantial loadings as are or may be present at installation.

BRIEF DESCRIPTION OF DRAWINGS

The present invention may best be understood by reference to the following description, taken in connection with the accompanying drawings in which:

FIG. 4 is a bottom plan of the truss bracket of FIGS. 2 and 3.

FIG. 5 is an end view section of a mine showing the representative mine trusses of FIGS. 1–4 as being installed as a roof truss, and also when elongated, as a floor truss.

FIG. 5A is an end view in section of a mine opening, without any mine truss structures, but illustrating the essentially parabolic tensile stressed area above the mine roof line and also a compression zone in the strata immediately beneath the floor line of the mine.

FIG. 6 is an enlarged fragmentary detail, shown principally in section and taken along the line 6—6, illustrating the configurement wherein a wire mesh and also abutment plates for additional rock anchors are included to further deter or eliminate tendencies of the floor of the mine to heave.

FIG. 7 is a top plan in fragmentary view of the structure of FIG. 6.

DESCRIPTION OF PREFERRED EMBODIMENTS

Figure 1:
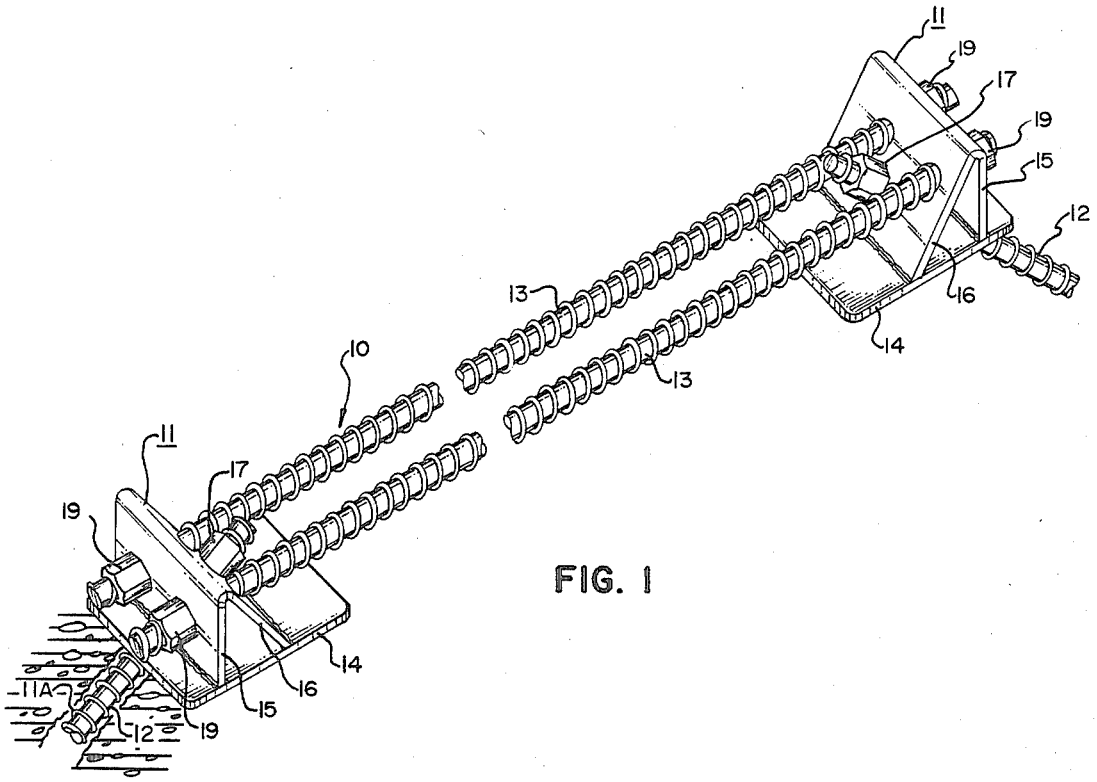
FIG. 1 is a perspective view of a mine truss forming a part of the present invention.
Figure 2:
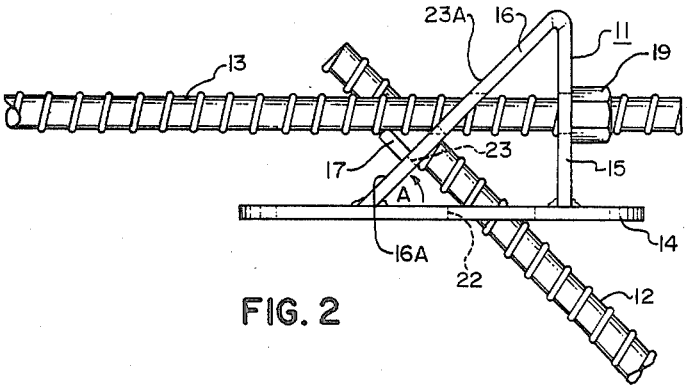
FIG. 2 is a fragmentary, enlarged, side-elevation of a representative side, in this instance the right-hand side of the mine truss of FIG. 1.

In FIGS. 1–4 truss assembly 10 is shown to include a pair of oppositely-facing truss brackets 11 which are secured in place by anchor bolts, i.e., roof bolts or floor bolts 12, and between which are disposed the spanning tie rods 13. Each of the truss brackets 11 includes a truss bearing plate 14 which is essentially horizontal in disposition, enlarged for support beyond plates 15, 16, and which is thus provided with a vertical, depending tie rod reaction plate 15 and an angulated anchor bolt bearing plate or member 16 having an exterior hypotenuse surface. The bearing plate 16 forms the hypotenuse of the triangular form of the truss, the smaller included angles approximately 45°. The permissible range of the orientation of plate 16 relative to the other plates, for 45°-installed anchor bolts, will be between 40° and 50°. This is for the purpose of effecting a correct truss relationship for proper retentive holding of the anchor bolt 12, at 90° with respect to plate 16, when tightened by its respective nut 17. The plates will be spec-welded together for maximum strength; similarly, the material size or gauge of the plate will be chosen to provide the strength necessary, depending upon the installation in which the trusses are employed. The two trusses 11 are identical in construction, one being simply rotated 180° about its vertical axis so as to provide for the assembly 10 as indicated.

The rods 31, oppositely offset relative to anchor bolt orientation, may be any number but in the construction shown are two in number, and these simply comprise wholly or partially threaded rods such as the DYWIDAG thread bars as manufactured, by way of example, by the DWIDAG Systems International, USA, Inc. It must be understood, however, that other types of rods can be employed, so long as partial or whole threads are utilized for coaction with tightening nuts 19 that are threaded onto the rod ends.

Rather than welding, the wedge-shaped truss brackets can be manufactured as castings or forgings. However, it is believed that, for purposes of desired strength, a welded construction for the truss brackets hereinabove described will be preferable.

In installation and operation, the anchor bolts 12 will be installed with suitable resin or other types of anchorage into the pre-drilled roof or floor bolt bores or holes 11A. There are various ways of anchoring anchor bolts such as roof bolts, as is well known in the art. For example, quick setting resin constructions, multi-time resin constructions, wedge-joints or expansion joints can be employed such that, in any event, at least the outer extremities of the anchor bolts are firmly secured in the pre-drilled strata. Subsequent to this, the truss is made up by the truss brackets being installed over the roof bolts in the manner shown and the roof bolt nuts 17 being tightened to bear against the respective nut bearing surfaces 16A. Appropriate tension is thus supplied to the respective, e.g., roof bolts.

In mine roof installations, for example, it should be mentioned at this juncture that in standard practice in the installation of roof bolts in mines, the essential 45° criterion is used. However, in those instances where one needs a greater vertical-force component relative to roof bolt tension such as, for example, where the angulation for the e.g. roof bolt relative to the horizontal is or approaches 60°, then the plate 16 can be reoriented such that the bearing surface thereof relative to the roof bolt nut will be at a 90° relationship relative to the axis of the new orientation of the roof bolt. In this event, angle A will be approximately 30°. Again, however, this is an unusual practice since for the 60° roof bolt orientation, the bolt would have to be of sufficient length such that its anchorage will appear over the compression zone immediately above the pillar area of the mine being trussed. Such then elongation of the roof bolt is not necessary where the 45° orientation is used.

To accommodate the placement of the tie rods and anchor bolts various oversized apertures will be employed such as apertures 20 and 21 relative to the tie rods and elongated aperture 22 relative to plate 14. As to a respective anchor bolt 12 itself, aperture 23 is provided as a passageway and serves in combination with aperture 22 to accommodate roof or anchor bolt placement, the surface 23A being a bearing surface for the nut 17 that tightens the anchor bolt in place.

Finally, securement apertures 24 and 25 accommodate the tie rods utilized. It should be noted that, depending upon anticipated mine conditions, the various apertures may be designed to accommodate any anticipated offset relative to adjacent portions of the roof of the mine along a horizontal roof plane. Accordingly, if there is any angulation present because of essential displacement of the roof surface at the opposite bracket locations and, considering the thickness of bracket material, then the apertures at 23, 24 and 25 may be made oversized to accommodate ease of assembly. It should be observed that the tightening function of the nuts relative to the roof bolts and the tie rods can be made in accordance with the particular roof orientation encountered.

At this juncture, it is important to observe that the naturally occuring stress distribution pattern of a mine roof is different from that experienced as to a mine floor. See FIG. 5A.

Without the installation of a truss, and considering a roof area between two adjacent mine pillars, it will be noted that there is a tensile area or tension force distribution pattern which resembles somewhat a parabola PA with the covex area thereof pointing upwardly. That is to say, there are forces of tension in the rock strata which progressively increase as the center of the roof between the mine pillars is approached. What is needed, and what has been pointed out extensively in the literature, is the fact that, to avoid other types of constructions such as the wood crib construction, the prior literature has concentrated on other types of trusses so as, by the use of mine bolts and a horizontal truss structure underneath the roof, to place the strata above the roof line at the tensile stress zone in compression. Additionally, the roof bolts will be anchored in areas in compressed areas above the rib-line R1 of ribs R of the mine pillars. The rock in compression immediately above the roof line and interior of the truss span, in being in compression, is held so that there will be precluded any roof drop-out at trussed areas.

The situation as to the mine floor is quite different. The mine floor strata condition, as contrasted with the roof and its naturally occurring tensile zone, is different in that floor does not have a natural tensile zone. Rather, the floor is basically all in minor compression, owing largely to downward pillar thrust. The action of a truss structure, now newly proposed, on the floor of a mine entry, for example, would be to pre-load the floor zone and increase the compressive forces, particularly horizontal compressive forces, if present, which may already exist in the floor zone thus to tend to deter upward floor heave. These adjacent pillar zones cause naturally occurring compressive forces to act downwardly and, because of the horizontal nature of the floor strata, these forces thrust elemental floor volumes inwardly in compression and toward the central portion of the mine entry floor. Such a condition is particularly aggravated when a weak clay stone or other rock type occurs within approximately 5 to 10 feet of the floor line. In such cases the vertical compressive forces from the pillars are translated to horizontal forces along these weak strata, causing floor rupture and heave.

Where a truss structure is to be employed for precluding floor heave, then the truss brackets will be made of appreciably heavier material; likewise, the tie rods and anchor bolts used will be of substantially heavier material.

FIG. 5 illustrates employment of the present invention's truss assembly in a floor installation as well as in roof installation, but with the brackets spread apart a greater distance so as to place as much of the floor in increased compression as possible. Thus, truss assembly 10 includes depending anchor bolts which are each angulated outwardly, generally in 45° relationship relative to the vertical and are being tensioned by respective nuts 17 bearing upon bracket plate 16 of respective truss bracket 11. The anchor ends of the bolts are secured in place in the rock formation beyond the rib line of the pillars, this so that the compressive forces set up by the pillars can be utilized in the retention of the bolts in the rock strata. The horizontal tie rods 13 are placed under tension by the tightening down of nuts 20 and 21, this so as to increase substantially the compression forces in the rock strata below the floor line, and this to an extent such that floor heave upwardly is avoided. Accordingly, there is resisted the tendency of materials proximate the center area of the floor to proceed upwardly under the compressive forces beneath this floor area as contributed by the downward pressure of the pillars on opposite sides of the mine opening. For floor installations, 3 there will be substantial increases in the material thicknesses making up the brackets, as well as in the horizontal tie rods so that the tremendous pressures as might be experienced through the weight of the overburden over the pillars, and the pillar weights themselves, can be offset by the tension of the tie rods and the compressive forces produced thereby in the rock strata immediately beneath the floor level.

In connection with the tremendous pressures that are experienced as to floors and potential floor heave, it is strongly urged that the trussed area be at least 80 percent of the distance between the pillars; also, that the securement bolts be substantially well under the mine pillars and elongated and allowed for a substantially increased anchorage area. This situation in connection with mine floors is to be contrasted with the force distribution pattern experienced at the roof wherein, as a rule of thumb, the parabolic tensile zone approximates sixty percent of the roof area, twenty percent being on either side of such area and being essentially in compression. As to the roof, the brackets should be placed inwardly about 1/5th of the distance from the pillar rib line, or slightly less so as to insure that the entire tensile zone is encompassed. With the floor, however, a substantially greater extent of the floor must be trussed and additional anchorage utilized.

FIGS. 6, 7 illustrate a further elaboration that can optionally be used in trussing mine floors, where the particular strata encountered dictates such a construction. In FIGS. 6, 7 it is noted that there is disposed beneath bracket 11 and the rods 13 a wire mesh W or material similar to chain link fences. This can proceed across underneath the bases of the truss brackets to aid in the prevention of floor heave. Additionally, and once the wire mesh and the basic trusses, in single or multiple units, are installed, additional holes may be drilled as at 26 and anchor bolts 27' with nuts 27A installed, with the anchor bolt nuts, bolt heads or reaction portions thrusting against a respective plate 28 that overlays the mesh. A series of holes and bolts can be installed to accomplish these purposes. Finally, see FIG. 10, adjacent pairs of tie rods 31, or channels 13A substituted therefor, may be conveniently joined together by longitudinally disposed rods 27 which are secured to the aforementioned tie rods by suitable juncture brackets 28 of any convenient form. The precise structure employed here are optional and may vary in accordance with particular installations desired. The essential point is that the tie rods or tie rod pairs can be coupled together in any convenient manner, and, additionally, mesh can be employed for further insuring against floor heave. Additional structural reliability is achieved through the employment of the additional bolts 27' hereinabove described.

While believed less satisfactory, there are other types of trussing structures that can be employed for use in mine floors. These will include the so-called Bethlehem design of trusses as fully disclosed in U.S. Pat. No. 4,395,161 which is fully incorporated herein by way of reference. Also employable with the floor structure is the so-called Birmingham truss structure as is shown in U.S. Pat. No. 3,505,824 issued to White, which also is fully incorporated by way of reference.

Figure 8:
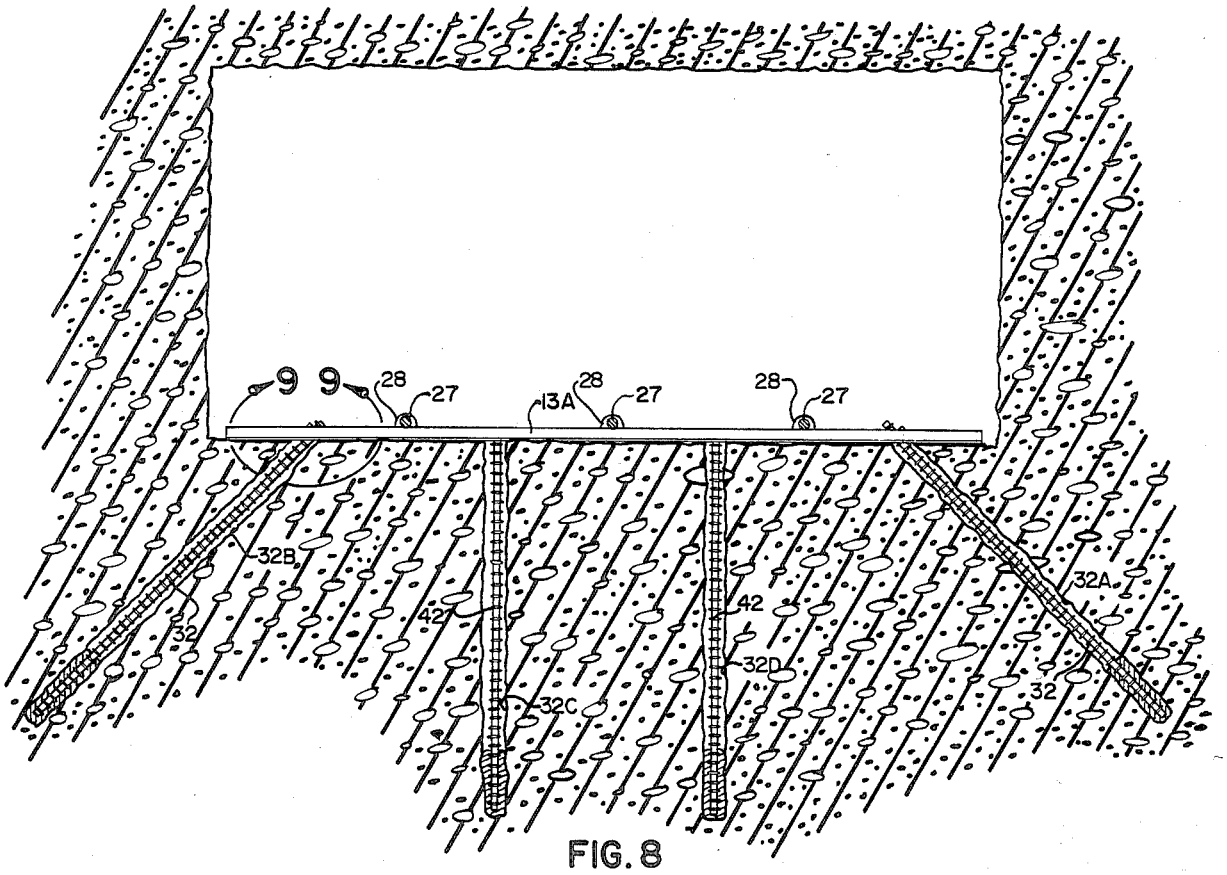
FIG. 8 is similar to FIG. 5 but illustrates as to the reinforcing structure for the mine floor an optional embodiment of the invention wherein cross channels are used, each of the channels being provided with suitable means for facilitating bolt anchor attachment;. this figure also illustrates additional vertical structure for anchoring the channels, and any mesh or rods disposed underneath, directly against the floor of the mine, as for example, between its pillars.
Figure 9:
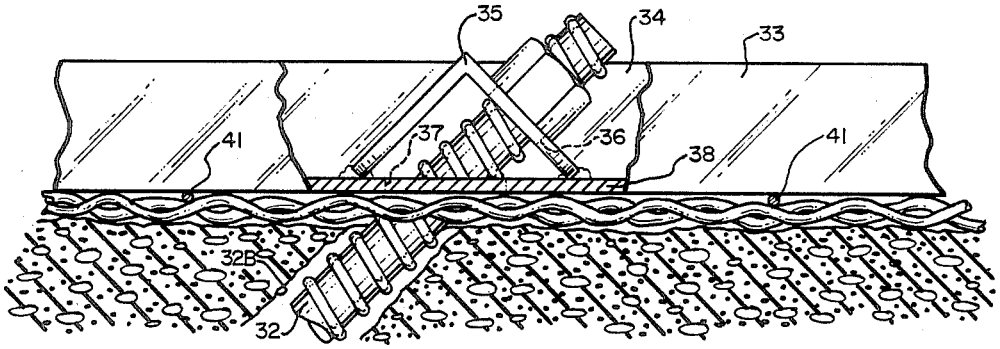
FIG. 9 is an enlarged fragmentary detail, princiapply in section and taken along the line 9—9 in FIG. 8, illustrating the method of attachment of the anchor shanks or bolts used to secure the structure to the rock formation below, the reaction structure primarily being indicated in section.
Figure 10:
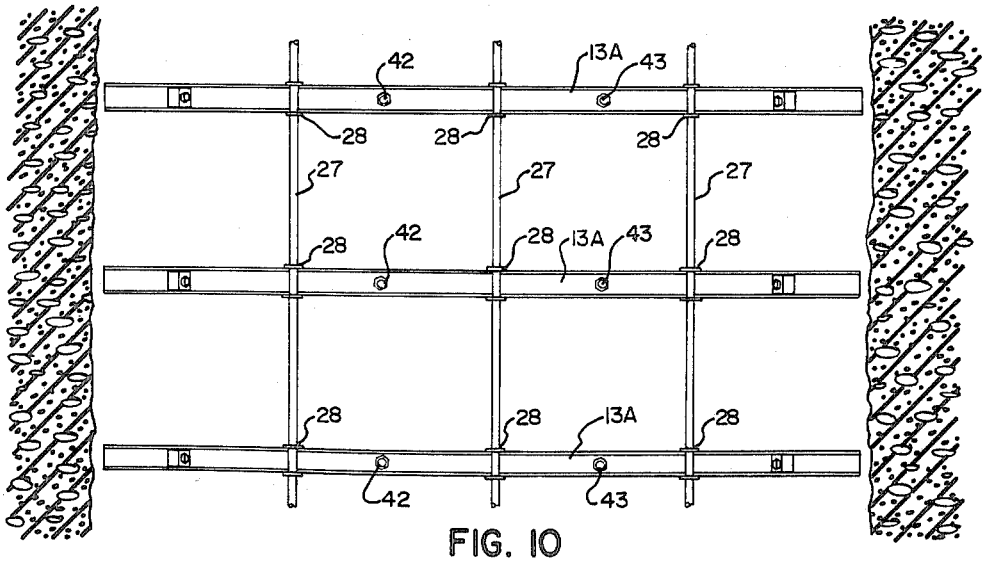
FIG. 10 is a plan view illustrating a succession of trusses being installed, whether of channel form as in FIG. 8 or as in the tie rod form of FIG. 5; in either event, the wire mesh if used may include rods that can be mounted to the individual channels as the case may be and fasten the entire structure together so that the same will bear directly against the mine floor.

In FIGS. 8 and 10 an optional construction is shown in connection with the trussing of mine floors. A series of truss assemblies 10 are provided each of which include a respective channel 13A and also depending bolts 32 which are installed similarly to roof bolts. Disposed between the upwardly oriented legs 33 and 34 of the channel is an inverted angle iron bracket 35 that is welded in place and which includes aperture 36 together with corresponding aperture 37 of the base 38 of the channel for receiving the bolt and the tightening of the same through its associated nut to the channel. This construction will exist at opposite end portions of the channel for each channel employed. Additionally, the channels can be disposed under and/or over horizontal tie rods or bars at 41, and the latter implaced over mesh 42.

In installation the mesh would be disposed over the floor first. Subsequently, the essentially parallel horizontal tie rods will be implaced and can be secured together between themselves or to the later installed channels by any conventional means as desired, as the case may be. Subsequently, the angulated holes at 32A and 32B are drilled, accompanied by the optional drilling of representative holes 32C and 32D, the latter has as many holes as may be desired. Subsequent to the drilling operation the bolts 32 are anchored down and the channels tightened by the appropriate nuts 40 and 41 against the angle iron 35 as previously described. After this operation has been completed, additional bolts as at 42 and 43 may be installed through reinforcing plates 44, etc. of the channels, and appropriate nuts or other attachments used to secure the channels down with the vertical bolts being under tension. The spacing of the channels along the drift is optional depending upon the conditions that are encountered and the trussing desired.

The above trussing concept relative to floors is believed to be completely new and is applicable to coal mines, metal mines, that also in connection with even highway tunnels, by way of example, where civil engineers simply drill through a hill or mountain area and need to preclude a floor heave going through such tunnel. In such event, any one of the several structures described can be utilized and installed at the floor and thereafter, concrete and appropriate road material deposited so that the roadway can be completed. In such event, however, the materials used will need to be anodized or otherwise treated to prevent rusting and/or other deterioriation.

The above techniques and structures described will be suitable as well for phosphate mines, trona mines, anywhere long-wall or short-wall techniques are employed, etc.

Figure 11:
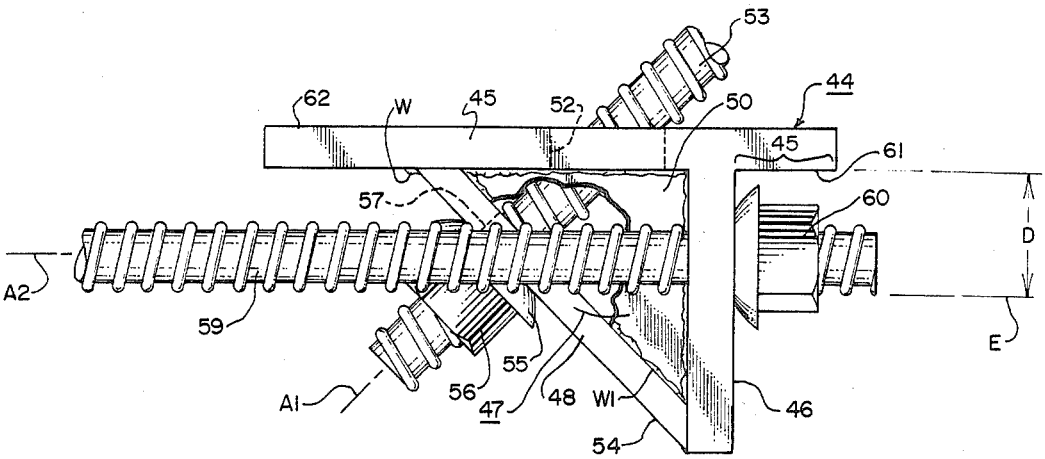
FIG. 11 is a side elevation of a preferred form of one type of truss bracket, the same being shown as installed and accommodating rod means to be disposed intention.

In FIG. 11 the truss bracket 44 is shown to include a horizontal bearing plate 45 and a tie rod nut reaction plate 46 depending therefrom and integral therewith. The bearing plate 45 and reaction plate 46 will assume a mutual, 90° orientation. Interposed in the structure to the left of reaction plate 46 is a gusset member 47 which, in the embodiments shown in FIGS. 11 and 12, includes an angulated or hypotenuse anchor-bolt bearing plate 48 and a pair of gusset plates 49 and 50 which are welded to bearing plate 48 and also to the bearing plate 45 and reaction plate 46. The gusset plates are in right-triangular form and are welded in place both to bearing plate 48 and also to bearing plate 45 and reaction plate 46. Accordingly, in the embodiments shown in FIGS. 11 and 12, the interior of the triangular gusset member 47 is hollow at 51. An enlarged aperture at 52 will be supplied in bearing plate 45 to accommodate passage of anchor bolt 53. The outer bearing surface 54 of bearing plate 38 will serve as a reaction-surface contact for the forward engagement end 55 of anchor bolt nut 56. Aperture 57 thus will be provided for anchor bolt 53 passage in the angulated bearing plate 48. Apertures 53 and 54 will be provided in the vertical reaction plate 46 and are seen in FIG. 12.

Figure 12:
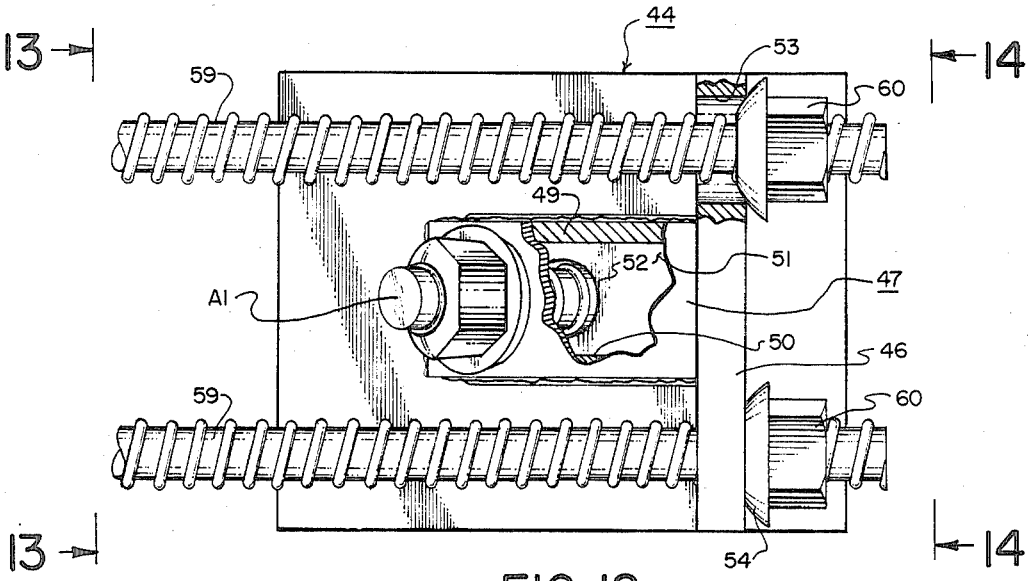
FIG. 12 is a bottom plan of a structure seen in FIG. 11 and is partially cut away in section for convenience of illustration.

There are a number of features and advantages in connection with the preferred truss bracket 44 in FIGS. 11 and 12. In a preferred form of this truss bracket the intersection of surface 54 with axis A1 of the anchor bolt 53 should lie along the horizontal plane joining the axes A2 of parallel tie rods 59. These latter, of course, will be provided with tie rod tension producing nuts 60 which are threaded on such tie rods. Accordingly, where the intersection between surface 54 and axis A1 is aligned with axis A2 of the tie rods, then there will be a maximum of stability in the truss bracket when the nuts 56 and 60 are tightened down. This is because the horizontal force component of tension produced in anchor bolt 53 will likewise lie in the same plane as joins axes A2 of the two tie rods 59; hence, no force-couple will appear as between the tension force vector lying along the axis of the tie rods and the horizontal force component of the tension produced in anchor bolt 53. An outer limit for the desired position of the intersection between surface 54 and axis A1 will be at extremity E as seen in FIG. 11. The distance D between surface 61 and extremity E is a permissible range within which the horizontal component of such force vector may appear; thus, extremity E defines the maximum or lowest permissible orientation of the intersection between surface 54 and axis A1. To remove the force couple altogether, and as before mentioned, the intersection of the plan defined by surface 54 and axis A1 should appear in line with axis A2 of tie rods 59 so that these are coincident.

Figure 3:
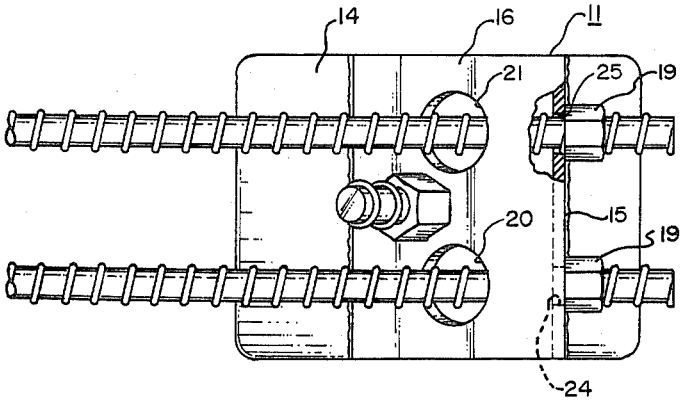
FIG. 3 is a top plan of the structure of FIG. 2, the tie rod means shown in FIG. 2 being deleted for purposes of clarity.

A further effort in reducing the possible appearance of force couples is in the provision of a pair of tie rods 59 equally spaced from and on opposite sides of the axis A1 of anchor bolt 53, also as shown relative to bracket 11 in FIG. 3. Accordingly, as the nuts 60 are torqued down so as to place the tie rods in tension, there will be no turning moment generated relative to the centrally placed anchor bolt 53. Again, oversized aperture 52 is provided as a passageway for anchor bolt 53 in the bearing plate 45.

Owing to extreme loadings of in-situ installation of the truss bracket 44, there should be a substantial "beafing up" of the structure of the gusset member—hence, the provision of gusset plates 49 and 50 which are welded in place both to the angulated bearing plate 48 and also to bearing plate 45 and reaction plate 46. This likewise provides ease of machining, especially as to bearing plate 48 where the same is initially produced, chamfered at its ends in angulated form as seen in FIG. 11, and then simply welded in place at W at its several junctures with the remaining structure. Likewise, the gussets will be completely welded in place about their peripheries at W1.

Figure 13:
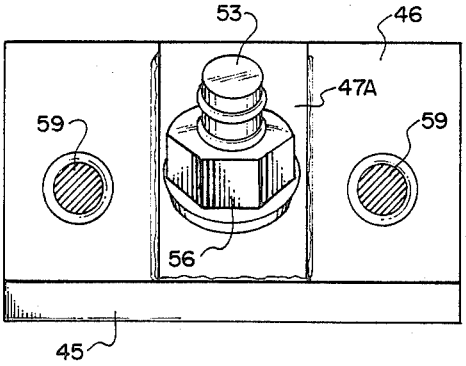
FIG. 13 is a front elevation of the structure in FIG. 12, being taken along the line 13—13 in FIG. 12, and also illustrates that the central triangular portion may be solid when so desired.
Figure 14:
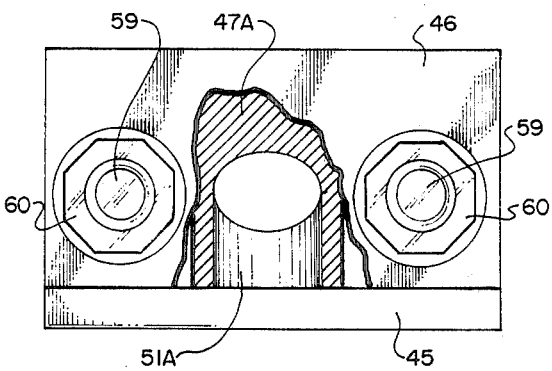
FIG. 14 is an end elevation taken along the line 14—14 in FIG. 12, and is partially broken away to indicate the solid nature, in one form of the invention, of the triangular portion of the truss bracket; a similar structural condition is also seen in FIG. 13.

FIGS. 13 and 14 illustrate end views of a structure shown in FIGS. 11 and 12, and, additionally, illustrates that the gusset member may be solid rather than hollow. This is seen in connection with gusset member 47A. In such event, of course, an aperture 51A will be provided for anchor bolt 53 which will provide the access of the hollow area at 51 where the gusset member is fabricated from the two gusset plates and bearing plate 48 in connection with the embodiments shown in 11 and 12. However, in connection with the provision of a solid triangular gusset member as seen in FIGS. 13 and 14, there will be necessitated the addition of machine time required to drill aperture 51A.

An initial impression that the structure of FIGS. 13, 14 could be simply cast. However, to produce the material strengths clearly approaching that necessitated in truss installation and suitable tightening down of the anchor bolt 53 and tie rods 59, the pre-cast structure would have to be extremely bulky and very heavy. It is much preferred that suitable bar stock be enclosed to fabricate the bracket and suitable high-spec welding be employed to accomplish the fabrication of such truss bracket. In such event a high-strength structure can be achieved without the massive bulk required should one take a casting approach.

The truss brackets illustrated in FIGS. 11 through 14 may be substituted for or used in conjunction with the installations of any of the prior figures, and this advantageously.

A final note: the bearing plate 45 should be extended at 45' to the right in FIG. 11 so as to provide an increased surface area for surface 62, this to retain the abutting rock formation in place substantially at opposite sides of the upward extension of anchor bolt 53 in FIG. 11. Surface 62 needs to contact the rock formation surface for substantial distances on opposite sides of anchor bolt 53; especially as this is a case where the anchor bolt assumes an orientation constituting a pronounced deviation from the vertical.

While particular embodiments of the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of this invention.

I claim:

1. A mine truss including, in combination: a pair of mutually facing truss brackets, each of said brackets including a horizontal truss bearing plate, a vertical, tie-rod securement end plate having an outer bearing surface, and an angulated, anchor bolt securement member having an outer hypotenuse surface, said bearing plate, vertical plate, and angulated member being made integral with each other such that the outer surfaces of said plates and member, when combined, form essentially a triangle, said angulated member having a central anchorbolt securement aperture, said end plate having a pair of tie rod securement apertures equally and oppositely offset relative to said anchor bolt securement aperture, said horizontal plate having a central anchor bolt passage aperture nominally aligned with said anchor bolt securement aperture; a pair of threaded tie rods extending through and between said truss brackets, passing through respective ones of said securement apertures of said end plates of said truss brackets; plural reaction nut means threaded onto said tie rods and bearing against outer bearing surfaces of said end plates; a pair of anchor bolts having threaded shanks respectively passing through said passage aperture of said horizontal plate and also through said securement aperture of said angulated member of respective ones of said truss brackets, the outer hypotenuse surfaces of said angulated members being oriented at essentially right angles to said anchor bolts when installed and tightened, and outwardly disposed nuts bearing inwardly against said angulated members and threaded upon said anchor bolts, said anchor bolts being disposed centrally between and mutually equally spaced from said tie rods.

2. The structure of claim 1 wherein said angulated plate and said end plate of each said truss brackets are welded to each other and to said horizontal plate, such weld of said angulated member to said horizontal plate extending also around opposite edges of said angulated plate.

3. An essentially triangularly-shaped truss bracket having three sides the first and second of which are essentially at right angles to each other and which respectively comprise strata abutment and tie-rod-tensioning reaction members, and a third side forming essentially a triangle hypotenuse, central anchor bolt accommodating angularly-aligned apertures disposed in said first and third sides, and a pair of apertures disposed in at least said second side, said apertures being equally and oppositely offset relative to said anchor bolt accommodating apertures.

4. The structures of claim 3 wherein said first side extends substantially outwardly beyond said second side.

5. A truss bracket including, in combination: a horizontal bearing plate; a reaction plate depending from and made integral with said bearing plate; a triangular gusset member joined to and between said bearing plate and said reaction plate on one side thereof, said triangular gusset member having an outer planar hypotenuse surface, said bearing plate and said gusset member being provided with a common slanted anchor bolt passageway having a central axis normal to and passing through said hypotenuse surface, said bearing plate extending beyond said reaction plate at its side opposite said gusset member; parallel tie rod apertures, having central axes, provided said reaction plate and disposed equidistant from said bearing plate and also disposed equidistantly on opposite sides of said passageway and beyond said gusset member on opposite sides thereof, the intersection of the plane defining said hypotenuse surface and the axis of said passageway being confined between said bearing plate and the outermost portions of said aperture relative thereto.

6. The truss bracket structure of claim 5 wherein a plane defined by the axes of said tie rod apertures essentially includes the point of intersection of said passageway at said outer hypotenuse surface.

7. The structure of claim 5 wherein said gusset member is interiorly hollow.

8. The structure of claim 5 wherein said gusset member is solid save only for said passageway, such passageway being comprising a bore hole.

9. The structure of claim 5 wherein said gusset member is formed by a hypotenuse plate, welded to said reaction plate and bearing plate, and by a pair of welded, side-opposite gusset plates enclosing the space defined between said hypotenuse plate and said bearing and reaction plates, said hypotenuse plate having an aperture forming in part said passageway.

10. The structure of claim 5 wherein said gusset member is centrally disposed relative to said reaction and bearing plates equidistantly between said apertures.

* * * * *